US008178021B2

(12) United States Patent
Suzuki

(10) Patent No.: US 8,178,021 B2
(45) **Date of Patent: *May 15, 2012**

(54) METHOD OF MANUFACTURING A DRAWN BIODEGRADABLE MICRO-FILAMENT

(75) Inventor: Akihiro Suzuki, Kai (JP)

(73) Assignees: University of Yamanashi, Yamanashi (JP); Gunze Limited, Kyoto (JP)

( * ) Notice: Subject to any disclaimer, the term of this patent is extended or adjusted under 35 U.S.C. 154(b) by 758 days.

This patent is subject to a terminal disclaimer.

(21) Appl. No.: 10/590,283

(22) PCT Filed: Feb. 22, 2005

(86) PCT No.: PCT/JP2005/003257

§ 371 (c)(1),
(2), (4) Date: Aug. 22, 2006

(87) PCT Pub. No.: WO2005/083165

PCT Pub. Date: Sep. 9, 2005

(65) Prior Publication Data

US 2007/0222104 A1 Sep. 27, 2007

(30) Foreign Application Priority Data

Feb. 26, 2004 (JP) ..... 2004-052377

(51) Int. Cl.

| | |
|---|---|
| ***D01D 5/12*** | (2006.01) |
| ***D01D 5/00*** | (2006.01) |
| ***D01D 5/04*** | (2006.01) |
| ***B29C 47/88*** | (2006.01) |
| *B29C 47/34* | (2006.01) |
| *B29C 55/00* | (2006.01) |
| *D02G 3/00* | (2006.01) |

(52) U.S. Cl. ..... 264/210.1; 264/204; 264/210.8; 264/211.12; 425/66; 428/364

(58) Field of Classification Search ..... None
See application file for complete search history.

(56) References Cited

U.S. PATENT DOCUMENTS 4,101,525 A * 7/1978 Davis et al. ..... 528/308.2

(Continued)

FOREIGN PATENT DOCUMENTS

JP 2007-305227 11/1995

(Continued)

OTHER PUBLICATIONS

Leenslag et al., Resorbable materials of poly(L-lactide). V. Influence of secondary structure on the mechanical properties and hydrolyzability of poly(L-lactide) fibers produced by a dry-spinning method, Sep. 1984, Journal of Applied Polymer Science, vol. 29, Issue 9, pp. 2829-2842, http://dx.doi.org/10.1002/app.1984.070290913.*

(Continued)

*Primary Examiner* — Christina Johnson
*Assistant Examiner* — Benjamin Schiffman
(74) *Attorney, Agent, or Firm* — Jenkins, Wilson, Taylor & Hunt, P.A.

(57) ABSTRACT

The invention resides in enabling biodegradable filament of polylactic acid, polyglycolic acid and the like to manufacture biodegradable micro-filament by simple and convenient means without needing special, high-accuracy and high-level apparatus; it is characterized in that highly molecular oriented micro-filament those of 12 μm or less and generally from 2 μm to 3 μm can be obtained by heating biodegradable filament by infrared beam and the heated original filament is drawn to 100 times or more by tension of 10 MPa or less.

9 Claims, 9 Drawing Sheets

U.S. PATENT DOCUMENTS

| | | | | |
|---|---|---|---|---|
| 4,340,563 | A * | 7/1982 | Appel et al. | 264/518 |
| 5,506,041 | A * | 4/1996 | Tanaka et al. | 428/219 |
| 6,497,952 | B1 * | 12/2002 | Ohkoshi et al. | 428/364 |
| 6,552,123 | B1 * | 4/2003 | Katayama et al. | 525/57 |
| 7,101,504 | B2 * | 9/2006 | Suzuki | 264/481 |
| 2003/0148688 | A1 * | 8/2003 | Matsunaga et al. | 442/327 |

FOREIGN PATENT DOCUMENTS

| | | |
|---|---|---|
| JP | 8-182751 | 7/1996 |
| JP | 2000-154425 | 6/2000 |
| JP | 2000-157622 | 6/2000 |
| JP | 2000-273750 | 10/2000 |
| JP | 2001-123371 | 5/2001 |
| JP | 2001-192932 | 7/2001 |
| JP | 2003-166115 | 6/2003 |
| JP | 2004-321484 | 11/2004 |
| WO | WO2005/083165 | 9/2005 |

OTHER PUBLICATIONS

Suzuki et al., PET microfiber prepared by carbon dioxide laser heating, Apr. 17, 2003, Journal of Applied Polymer Science, vol. 88, Issue 14, pp. 3279-3283, http://dx.doi.org/10.1002/app.12152.*

Suzuki et al., Mechanical properties and microstructure of poly(ethylene terephthalate) microfiber prepared by carbon dioxide laser heating, Sep. 17, 2003, Journal of Applied Polymer Science, vol. 90, Issue 7, pp. 1955-1958, http://dx.doi.org/10.1002/app.12903.*

Suzuki et al., Zone drawing and zone annealing of poly(ethylene terephthalate) microfiber prepared by CO2 laser thinning, Mar. 17, 2004, Journal of Applied Polymer Science, vol. 92, Issue 5, pp. 2989-2994, http://dx.doi.org/10.1002/app.20318.*

Suzuki et al., Superstructure and mechanical properties of poly(L-lactic acid) microfibers prepared by CO2 laser-thinning, May 23, 2005, Polymer, vol. 46, Issue 15, pp. 5550-5555, http://dx.doi.org/10.1016/j.polymer.2005.04.047.*

International Preliminary Report on Patentability corresponding to International Patent Application No. PCT/JP2005/003257 dated Nov. 8, 2005.

International Search Report corresponding to International Patent Application No. PCT/JP2005/003257 dated Jun. 21, 2005.

Suzuki, A., and Ishihara, M., "Application of $CO_2$ Laser Heating Zone Drawing and Zone Annealing to Nylon 6 Fibers," Journal of Applied Polymer Science. vol. 83, No. 8 pp. 1711-1716 (2002).

Suzuki, A., and Mochiduki, N., "Application of High Power $CO_2$ Laser-heating Zone-drawing to PET Fibers," Polymer Preprints, Japan. vol. 50, No. 4 p. 787 (2001).

Suzuki, A., and Mochiduki, N., "Mechanical Properties and Microstructure of PET Fibers obtained by Laser-Heating Zone-Drawing (III)," Polymer Preprints, Japan. vol. 50, No. 4 p. 787 (2001).

* cited by examiner

Fig. 7

Variation of diameters and birefringence by drawing of polylactic acid filaments Supply speed: 0.5 m/min
Watt density: 24 W/cm$^2$

| Wind-up speed | Filament diameter | Draw ratio | Birefringence | X-ray orientation degree | Drawing tension |
|---|---|---|---|---|---|
| m/min | μm | | x10$^{-3}$ | % | MPa |
| 100 | 5.02 | 223 | 6.89 | 61.8 | 2.5 |
| 200 | 3.97 | 357 | 10.26 | 75.2 | |
| 400 | 2.57 | 852 | 14.78 | 74.0 | |
| 600 | 1.75 | 1836 | 19.26 | 75.7 | 2.0 |
| 800 | 1.45 | 2675 | 20.29 | 73.4 | |
| 1200 | 1.45 | 2675 | 20.97 | | 0.6 |
| 1600 | 1.20 | 3906 | 23.25 | | 0.3 |
| 2000 | 1.20 | 3906 | 32.68 | | |

Fig. 8

Variation of diameters and birefringence by drawing of polylactic acid filaments Supply speed: 0.5 m/min
Watt density: 12 W/cm$^2$

| Wind-up speed | Filament diameter | Draw ratio | Birefringence | Drawing tension |
|---|---|---|---|---|
| m/min | $\mu$m | | x10$^{-3}$ | MPa |
| 100 | 4.98 | 227 | 11.66 | 0.3 |
| 200 | 4.50 | 278 | 13.16 | 2.7 |
| 400 | 3.29 | 520 | 13.97 | 0.9 |

Fig. 9

Variation of diameters and birefringence by re-drawing and re-heat-treatment of polylactic acid filaments

| Treatment | Filament diameter | Draw ratio | Birefringence |
|---|---|---|---|
| | $\mu$m | | x10$^{-3}$ |
| Laser drawing method | 1.45 | 2674 | 20.29 |
| Zone drawing method 1 (Drawing Temp.: 80℃) | 1.41 | 2829 | 30.28 |
| Zone drawing method 2 (Drawing temp.: 80℃) | 0.60 | 15625 | |
| Zone heat treatment method (Heat treatment temp.: 160℃) | 1.20 | 3906 | 40.63 |

Fig. 10

Polyglycolic acid Supply speed: 0.5 m/min

| Filament | Wind-up speed m/min | Filament diameter μm | Draw ratio | Birefringence $x10^{-3}$ |
|---|---|---|---|---|
| Drawn filament | 100 | 9.4 | 77 | 6.4 |
| | 300 | 5.7 | 208 | 7.0 |
| | 500 | 3.9 | 445 | 8.0 |
| | 700 | 3.3 | 427 | 11.3 |
| | 900 | 3.1 | 621 | 15.8 |
| | 1100 | 2.6 | 1025 | 17.5 |
| | 1300 | 2.3 | 1280 | 22.1 |
| | 1500 | 2.3 | 1280 | 27.0 |
| | 1700 | 2.2 | 1350 | 27.9 |

Fig. 11

Polyglycolic acid Supply speed: 0.5 m/min

| Filament | Wind-up speed m/min | Filament diameter μm | Draw ratio | Birefringence $x10^{-3}$ |
|---|---|---|---|---|
| Drawn filament | 100 | 16.0 | 167 | 5.3 |
| | 300 | 8.6 | 580 | 16.9 |
| | 500 | 5.1 | 1647 | 26.1 |

METHOD OF MANUFACTURING A DRAWN BIODEGRADABLE MICRO-FILAMENT

FIELD OF THE INVENTION

The invention relates to a method and an apparatus for manufacturing drawn biodegradable filament and especially concerns with biodegradable micro-filament as polylactic acid and polyglycolic acid drawn at high draw ratio of 100 times or more which can be obtained by those simple and convenient drawing means.

BACKGROUND OF THE INVENTION

In a field of fibers, various kinds of efforts have been made with regard to reduce a fiber diameter and make it to 10 μm or less. That has unique feeling and expensive-looking in apparel usage, and heat-retaining property, heat insulating property and printability are increased with enhanced covering power by increasing fiber density. Further, it is because fiber performances are greatly improved from various points in also industrial and agriculture usage such as to improve greatly flexibility of rope etc., heat-retaining property and also filter features.

Meanwhile, also in fiber industry, biodegradable fibers have been strongly required in also household use, and industrial materials; such as agriculture materials, diaper, packaging materials, etc. for transition to resource recycling type society from a viewpoint of global environment. But, although there is a point of view from raw material cost, it is difficult to make fibers of small fiber diameters as a spinning property and drawing property is bad in also a viewpoint of its manufacturing method and fiber performance (for example, Japanese Patent Laid-Open Hei. 7-305227). In addition, polylactic acid fibers which are typical biodegradable fibers were depended on plasticizer etc. (for example, Japanese Patent Laid-Open 2000-154425) as these are hard and brittle filament and have also a problem from performance side but additives of plasticizer etc. damage strength and heat resistance property and fiber properties are spoiled.

One of essential problematic point that biodegradable fibers have is a request for different biodegradable speed depending on intended end-usage; degradation completion term of rope and sheet for mulching are different in even agriculture usage, and also different from that of a diaper and wiping cloth. It is desired to prepare product groups having various degradation speeds without changing a kind of polymers to fulfill these requests.

Additionally, biodegradable fibers have many usages especially in a non-woven fabric fields and various manufacturing methods are proposed (for example, Japanese Patent Laid-Open 2000-273750 and Japanese Patent Laid-Open 2001-123371). Those are required non-woven fabrics of small filament diameters from a viewpoint of covering power and heat-retaining property of nonwoven fabrics and feeling etc. in a diaper. But, it was difficult to manufacture non-woven fabrics of small filament diameters simply and conveniently and cheaply as performance of spinning and drawing is bad.

In addition, as the broad sense of biodegradable fibers, there are bioerodible absorbable fibers (for example, Japanese Patent Laid-Open Hei. 8-182751) and thin and flexible filament with strength is required for surgical suture threads etc. Additionally, non-woven fabrics consisting of bioerodible absorbable fibers have been used also in various fields such as suture prosthesis, anti-adhesion material, artificial skin and cell culture substratum (for example, Japanese Patent Laid-Open 2000-157622 and Japanese Patent Laid-Open 2004-321484) from medical care side, also in these field, non-woven fabrics consisting of thin filament with strength are required.

On the other hand, the invention relates to drawing technology of filament by infrared rays heating but the technology concerning with these has been performed in many ways conventionally (for example, Japanese Patent Laid Open 2003-166115, pamphlet of International Laid Open No. 00/73556, Akihiro Suzuki, et al. Journal of Applied Polymer Science, Vol. 83, pp. 1711-1716, 2002, Akihiro Suzuki, et al., Preliminary Abstracts of Polymer Science Society, Japan, May 7, 2001, Vol. 50, No. 4, pp. 787, Akihiro Suzuki, et al., Journal of Applied Polymer Science, Vol. 88, pp. 3279-3283, 2003, Akihiro Suzuki, et al., Journal of Applied Polymer Science, Vol. 90, pp. 1955-1958, 2003). The invention, further improving these technologies, is made effectively applicable to biodegradable filament. In addition, a zone drawing method and a zone heat treatment method shown in the literature (Journal of Applied Polymer Science, Vol. 90, pp. 1955-1958, 2003) are beneficial means to conduct also redrawing or heat treatment of the drawn biodegradable filament of the invention.

Accordingly, the invention solves problematic points of biodegradable filament by further developing the conventional technology of above-mentioned inventor, and the object in the invention resides in to obtain highly drawn and oriented biodegradable micro-filament easily by spinning thick biodegradable filament at stable spinning condition and drawing them to high ratio with simple and convenient means. And the other object resides in to obtain filament used for surgical suture threads etc. which are flexible and have strength by making filament consisting of bioerodible absorbable polymer to be super-micro. Additionally, the other object resides in to be product groups with different biodegradable speed by various product (threads, rope, fabrics, non-woven fabrics and so on) groups different in filament diameters by this simple and convenient drawing means. In addition, the other object resides in to be able to manufacture long fiber non-woven fabrics consisting of biodegradable micro-filament having high degree of molecular orientation. Further, the other object resides in to offer non-woven fabrics consisting of bioerodible absorbable filament, which are used for suture prosthesis, anti-adhesive material, artificial skin, cell culture substratum, etc.

DISCLOSURE OF THE INVENTION

The invention relates to drawn biodegradable filament. Biodegradable filament is filament consisting of a biodegradable polymer, and a biodegradable polymer (JISK3611) is degraded relatively easily by a microscopic organism and a biologic enzyme existing in soil and seawater of natural world and its degradation product is harmless polymer material. The biodegradable filament in the invention is composed of above-mentioned biodegradable polymer; the polymer is a thermoplastic polymer, for example, it is said to filament that following polymers are a main component (30% or more). It consists of aliphatic polyester typified by polylactic acid, polycaprolactone, polybutylene-succinate and modified polymers etc. of those; these are a main component (30% or more) and may be one that also include the other component.

Aforementioned biodegradable filament is filament that strength becomes preferably ½ or less; further preferably 30% or less and the most preferably 10% or less according to elapsing 12 months in the ground. It is a prerequisite to have biodegradability in the ground to contribute to recycling type society with microorganism degradability.

Biodegradability of the invention means the biodegradability in the broad sense of the term, a case having bioerodible absorbability is also included. The bioerodible absorbability is said to a property that it has been absorbed within a biological body not to be a harmful substance, although it is used directly contacting cell, blood, connective tissue, etc. in a body tissue and degrades within a biological body. The bioerodible absorbable filament in the invention consists of above-mentioned bioerodible absorbable polymers, for example, it is said to filament consisting of the following polymers. It consists of aliphatic polyester typified by polyglcolic acid, polylactide, polyglutamic acid, poly-p-dioxic acid, poly-α-malic acid and poly-β-hydroxybutyric acid and modified polymer of those, these are a main component (30% or more) and may be one also includes the other components.

The invention relates to drawn biodegradable filament. The filament is the fibers that have substantially continuous length and it is distinguished from staple fibers that consist of short length (from several millimeters to several centimeters). A cross-section of biodegradable filament may also be various shaped one called modified cross-sections and hollow filament. Additionally, it may also be a sheath-core type composite fiber and a composite fiber of side-by-side etc. Still, the filament in the invention has a case that it is a single filament consisting of one filament and a case that it is multifilament consisting of plural filaments. Drawing tension applied to one filament is expressed sometimes "per single filament" but it means "per one filament" and in multifilament, "per individual one filament" that formed of those.

The invention provides means for drawing the original biodegradable filament. The original biodegradable filament in the invention may be already manufactured as the biodegradable filament and wound-up on bobbins and the like, or biodegradable filament to be the material for the drawing means in the invention which are formed into the biodegradable filament from molten or dissolved biodegradable filament by cooling or coagulation in the spinning process, and used successively in the spinning process. The biodegradable resins, especially polylactic acid and polyglycolic acid can not be spun at unreasonable high temperature as pyrolysis property is large, but it can be spun even if polylactic acid etc. of relatively large molecular weight at comparatively low temperature as an original filament of the invention may be thick.

The original biodegradable filament of the invention are characterized in that drawing property is not spoiled so much even if it is molecular oriented already. In the invention, there is a case that drawing is conducted with a swelled portion larger than the diameter of the original biodegradable filament at a drawing starting portion where it is drawn by infrared beam. Such a peculiar phenomenon has not yet been observed in usual drawing for synthetic fibers. It is considered that the phenomenon is derived from that the drawing temperature is increased to the melting point or thereabout of the original biodegradable filament and drawing in the narrow zone is enabled. As described above, by drawing with the swelled portion, it is enabled to draw at a draw ratio of 100 times or more, or 500 times or more and in suitable condition 1,000 times or more.

The original biodegradable filament of the invention is heated to an appropriate temperature for drawing by infrared beams irradiated from infrared heating means (including a laser). The infrared rays heat the original biodegradable filament but a range to be heated to an appropriate temperature for drawing is heated preferably within 4 mm in up-and-down (length direction 8 mm) from axial directions of the filament at the center of the filament, further preferably 3 mm or less and the most preferably 2 mm or less. The invention enables the drawing with high molecular orientation by the rapid drawing in the narrow region and that it was possible to decrease breakage of drawing even in super high draw ratio. Yet, the heating range in this case is within up-and-down 4 mm to a filament axis and there is no limitation in a right angle direction against a filament axis. Still, if the filament irradiated the infrared beams are multifilament, above-mentioned the center of the filament means the center of a bundle of the multifilament.

The irradiation of infrared beams of the invention is preferably irradiated from plural directions. In the biodegradable filament, it is considered that heating from one side only of filament makes it further difficult to draw filament that has large crystallization speed and is difficult to draw by asymmetry heating. Such irradiation from plural directions can be achieved by the irradiation of plural times along a passage of the original filament by reflecting the infrared beam with mirrors. The mirrors of rotating type, not only fixed types, such as a polygon mirror can also be used.

Additionally, as the other means of irradiation from plural directions, there are means to irradiate light sources from plural light sources to the original filament from plural directions. It is possible to be the high powered light sources by using plural laser emitters which are relatively small laser light sources and are stable and not expensive, that the method of using plural light sources is useful as the biodegradable filament of the invention need high watt density.

The wave length of infrared rays is said to be from 0.78 μm to 1 mm but a near infrared region about from 0.78 μm to 20 μm centering on the absorption at 3.5 μm for C—C bonds of polymeric compound is particularly preferred. For the infrared rays, heating heaters referred to a spot heater or a line heater narrowing the focal point into a line or spot shape by a mirror or a lens thereby narrowing the heating area for biodegradable filament with in 4 mm up and down direction or less in the center of filament can be used. Particularly, the line heater is suitable in a case of heating biodegradable filaments of plural number at the same time.

For the infrared heating in the invention, laser heating is particularly preferred. Among all, a carbon dioxide gas laser with a wave length of 10.6 μm and a YAG (Yttrium-Aluminum-Garnet series) laser with a wavelength of 1.06 μm are particularly preferred. Also, an argon gas laser can also be used. Since a laser can restrict irradiation range smaller and the energy is concentrated to a specified wavelength, wasteful energy is decreased. The carbon dioxide gas laser of the invention has the power density of 10 $W/cm^2$ or more, preferably 20 $W/cm^2$ or more and the most preferably 30 $W/cm^2$ or more. This is because the super high ratio drawing of the invention is enabled by concentrating the high power density energy to a narrow drawing region.

Generally, the drawing is carried out by heating the biodegradable filament and the like to an appropriate drawing temperature and applying tension thereon. The applied tension in drawing of the invention, characterized in that drawing is conducted by the tension provided by the own weight of filament. This is different in the principle, from usual drawing where drawing is conducted by the tension provided by the difference of speeds between rollers and by the tension caused by wind-up. In the invention, an optimal applied tension can be selected by changing the own weight of biodegradable filament applied to the heated portion (determined depending on the free falling distance from the heated portion) by the change of the free falling distance. In the usual drawing between rollers, it is difficult to control the draw ratio as large as 100 times or more. It is the feature of the invention that the ratio can be controlled easily by a simple and convenient means of distance. This drawing by the own weight can be used start-up method of super drawing of the invention. The original biodegradable filament is drawn by the tension applied by the own weight, keeping in status that high ratio drawing is conducted to an extent, subsequently guiding the filament drawn to the high ratio to a take-up device, it is possible to be drawn with predefined take-up speed.

Further, the tension in the invention is extremely reduced level, and drawing is conducted by setting applied tension to preferably 10 MPa or less, further preferably 5 MPa or less and the most preferably 3 MPa or less. If the applied tension exceeds 10 MPa, the breakage at drawing is liable to occur and the range of the applied tension as described above is preferred for drawing at a high draw ratio. With such small drawing tension, the extremely high draw ratio such as 100 times or more, depending on the condition 500 times or more or 1000 times or more can be realized. Because, drawing is conducted within extremely narrow drawing region while keeping an extremely high drawing temperature of the melting point or thereabout, so that biodegradable filament can be deformed with no breakage. In the usual drawing for biodegradable filaments between rollers, the filaments are drawn at applied tension of several ten MPa to several hundred MPa. The feature of the invention resides in drawing within a range greatly different therefrom.

In the invention, it is characterized in that the filament is drawn at a super high ratio of the obtained drawn biodegradable filament as 100 times or more, preferably 200 times or more, further preferably 500 times or more and the most preferably 1000 times or more are conducted. Considering that the draw ratio of polylactic acid which represents usual biodegradable filaments is 3 to 7 times, and even in super drawing of PET filament, it is about ten and several times. The invention has a feature in that drawing within an extremely narrow zone is enabled and, accordingly, the drawing temperature can be increased to the melting point or thereabout of the original biodegradable filament which decreases the drawing tension, and that means capable of controlling the small drawing tension and the super high draw ratio has been found. Since the drawing at the super high draw ratio is possible, this enables manufacture of the biodegradable super micro-filament with a diameter of 10 μm or less and further 5 μm or less such as 2 μm and 3 μm. And, the large draw ratio means to increase production speed for manufacture of the biodegradable filament to several hundred times, which is significant also in view of the productivity.

Drawing is conducted to the original biodegradable filament delivered from filament supplying means of the invention. As for supplying means, various types can be used if these can supply the biodegradable filament at constant supplying speed with nip rollers, driven roller groups and the like.

The original biodegradable filament delivered from supplying means of the invention is preferable to provide a guiding tool which controls the position of the original filament just before the infrared beam hit original filament. The just before position is preferably 100 mm or less, further preferably 50 mm or less and the most preferably 20 mm or less. The heating by infrared beam of the original filament characterizes in that the heating is conducted extremely narrow range and the position of biodegradable filament is required to be restricted for enabling the heating of the narrow range. Depending on the exit shape of a blowing duct to be hereinafter described, it is possible to have such function, but the blowing duct focus on air flowing of gas delivering biodegradable filament and easiness of passing biodegradable filament, and after that to control the position of biodegradable filament is preferable by the simple and convenient guiding tool. Although the guiding tool is not required in conventional ordinary drawing as the drawing tensions is large, but in the invention as the drawing tension is small and the draw ratio is large, and very little fluctuation and variation of the drawing point greatly affect the stability of the drawing. Accordingly in the invention, it is possible to contribute largely to the stability of drawing to provide the guiding tool just before the drawing point. As for the guiding tool in the invention, narrow duct or groove, a comb, a combination of fine bar, etc. may be used.

In above guiding tool, it is desirable to have a position control mechanism to be able to adjust finely the position of the guiding tool. For precisely fitting a running position of filament to a narrow region of laser beam, the guiding tool is necessary to control the position in XY directions.

The original biodegradable filament delivered by the supplying means of filament is desirable to be delivered further through the blowing duct by a gas flowing direction of the original biodegradable filament in the blowing duct. As for the gas flowing in the blowing duct, the gas of room temperature is used usually but when pre-heating of the original biodegradable filament is desired, heated air is used. And if the original biodegradable filament is prevented to be oxidized an inert gas such as nitrogen or the like is used and if scattering of water is protected a gas containing water vapor or water is used. Still, the blowing ducts are not necessary to a tubular shape but being groove shape, if the original biodegradable filament can flow together with the gas through in these. The cross section of the duct is preferably circular but may be rectangular or other shape. The gas flow through the duct may be supplied from one of a branched ducts, or may be supplied from an outer duct to an inner duct through apertures and the like using a double walled duct. An air jet interlacing nozzle for filaments used for interlace spinning or Taslan fabrication of synthetic fibers is also used for the blowing duct in the invention. And in a case of drawing by free falling as non-woven fabrics manufacturing in the invention, filament may be provided the drawing tension by air momentum according to the blowing duct of the invention.

In drawing of the biodegradable filament in the invention, it is characterized in that plural numbers of the original biodegradable filaments are gathered together and can be drawn in the same infrared beam. Usually, if the plural numbers of original filaments are drawn together, agglutination among the drawn filaments occurs but in polylactic acid, it is possible to draw without the agglutination as its crystallization speed is fast. The plural numbers of filaments mean that the drawing can be conducted for 2 or more and in some case 5 or more filaments.

The drawn biodegradable filament of the invention is wound-up around a bobbin or a cheese in a following process into products of bobbin-wound or cheese-wound form. In these wind-up processes, the drawn biodegradable filament is preferably wound-up while being traversed. This is because uniformly wound-up form can be ensured by traversing. In the biodegradable micro-filament, occurrences of breakage of filament or fluff result in a most significant problem. In the invention, since filament is highly molecular oriented and drawing tension is small, the filament can be wound-up with a small winding tension, it is characteristics of the invention to decrease also occurrence of breakage of filament or fluff. Yet, when the plural filaments are drawn and wound-up simultaneously, it is possible to wind-up twisting by a twister but it is preferable to wind-up entwining among filaments by an interlace method as running speed of the filaments of the invention is fast.

Subsequent to the drawing step of the invention, a heating apparatus having a heating zone may be disposed to apply a heat treatment to the drawn biodegradable filament. Heating can be conducted by means passing them through a heated gas, radiation heating such as infrared ray heating, passing them over a heating roller, or means such as a combination of them. The heat treatment can provide various effects such as reduction of thermal shrinkage of the drawn biodegradable filament, increase in the degree of crystallinity to decrease aging change of the biodegradable filament or improve Young's modulus. In the case of non-woven fabrics of the invention, the heat treatment may also be applied on a conveyor.

The drawn biodegradable filament of the invention can be wound-up after additional drawing. For the drawing in the subsequent step, drawing means by infrared ray used in the previous step can also be used. In a case where the filament has already been drawn at a sufficiently high draw ratio in the previous step and the biodegradable micro-fibers have already been obtained, inter-roller drawing such as usual godet rollers and pin drawing may also be used. And a zone drawing method and a zone heat treatment method developed by the inventor (Journal of Applied Polymer Science, Vol. 90, pp. 1955-1958, 2003) are especially useful means in also conducting further drawing. By this zone drawing method, the drawn biodegradable super micro-filament that filaments diameters are 3 μm or less and reaches 2 μm can be obtained.

In the invention, it is characterized in that stable drawing is controlled by constant drawing tension, draw ratio, etc. with controlling watt density of infrared beam. Additionally, controlling wind-up speed or supply speed, or both wind-up speed and supply speed according to measuring a filament diameter and feeding back them; it can be controlled to obtain a product of a constant filament diameter. In the invention, a drawn filament diameter is easily fluctuated as draw ratio is large but stable production can be conducted by always controlling a filament diameter.

Non-woven fabrics consisting of the drawn biodegradable filament can be manufactured by accumulating the drawn biodegradable filament of the invention on a running conveyor. In recent years, non-woven fabrics have been demanded vigorously in various fields taking notice on the peculiar characteristics of the non-woven fabrics not merely as substitutes for woven fabrics. Among them, non-woven fabrics of micro-fibers include melt blown non-woven fabrics which are prepared by blowing off molten filament by hot blow to form filament of 3 μm or thereabout and then accumulating them on a conveyor to form non-woven fabrics. They are used mainly for air filters. However, filament constituting the melt blown non-woven fabrics has lower strength than usual non-drawn fibers as 0.1 cN/dtex or thereabout, in which a number of small lumps of resins called as shots or wads are present. The non-woven fabrics consisting of the drawn biodegradable filament of the invention have strength equal with or superior to that of usual drawn synthetic fibers while having a diameter of about 3 μm or thereabout like melt blown non-woven fabrics because the biodegradable filament is highly molecular oriented. And it is possible to prepare non-woven fabrics without containing shots and wads at all. The non-woven fabrics of the invention, adding to effects of being fine texture and luster, light weight, heat insulation, heat retention, water repellent, improved printability and the like by being micro-filament, these can also have characteristics that biodegradable speed of biodegradable filament is quickened. And the non-woven fabrics consisting of biodegradable filament of the invention have characteristic that any filament has the same degradable speed as filament diameters are uniform. Especially, filament of polylactic acid and polyglycolic acid is hard and fragile filament but become one that is soft and good feeling by to be micro-filament according to the invention, and a feature occur that these can be used even in sanitary goods of a diaper etc. Still, as described in a section of back ground art, it is variously discussed conventionally for spunbonded non-woven fabrics consisting of biodegradable filament but filament of the invention have strength and a smaller diameter than those spunbonded non-woven fabrics.

Non-woven fabrics have been made to sheet shape conducting usually any entwining or interlacing among fibers. In the invention, a number of biodegradable filaments per unit weight are extremely increased as filaments diameters are extremely small. Accordingly, not providing an interlacing process especially, the biodegradable filaments are interlaced by vacuum suction below the conveyor and there are many cases that simple pressing up on accumulation of the biodegradable filament on a conveyor is sufficient, with no particular interlacing or entwining process like melt blown non-wove fabrics. Naturally, means such as thermal embossing or needle punching, water-jet, adhesive bonding conducted in usual non-woven fabrics may also be used, which maybe selected depending on application use. In the filter usage as a major application use of micro-fiber non-woven fabrics, collecting efficiency can be increased outstandingly by applying electrostatic treatment to the non-woven fabrics and non-woven fabrics of the invention can also be applied by electrostatic treatment to the field of the filters. When the biodegradable filament is accumulated on the conveyor in the manufacture of the non-woven fabrics of the invention, negative pressure is applied at the back of the conveyor and the flow of air under air suction by negative pressure or the flow of air by the positive use of an air sucker sometimes act as tension for drawing in the biodegradable filament drawing, which is also included in the drawing tension of the invention.

The invention is characterized in that various different filaments diameters can be produced according to using simple and convenient drawing means. The biodegradable filament has different biodegradable speed by filaments diameters. Large diameter filament is slow in biodegradable speed and small diameter filament is fast in degradable speed. Accordingly, as products of biodegradable filament for example regarding rope, preparing product groups differing in filament diameter such as several ten μm to several μm, it is possible to make a product group of different biodegradable speed depend on usage, climate of the district, etc. And, when manufacturing a mulching sheet for agriculture with non-woven fabrics of biodegradable filament of the invention, it is possible to be the product group of controlled biodegradability according to changing a filament diameter by usage.

Molecular orientation of filament in the invention can be shown by birefringence. Birefringence of drawn polylactic acid filament of the invention show extremely high value and it is understandable that those are highly molecular orientated. Birefringence value of a crystal of polylactic acid is said to be 0.033 or thereabout. Birefringence value of drawn polylactic acid filament by the invention is 0.015 or more by being well drawn, further there are many more than 0.020, and there exist also more than 0.030 with extremely drawn one. Additionally, by re-drawing, birefringence that reaches 0.04 is also obtained. In that sense, drawn polylactic acid of the invention is understood to be extremely highly oriented. A measuring method of birefringence in the invention depended on a retardation method.

Yet, orientation degree f of filament in the invention is shown by X-ray half-value breadth method of a following equation.

$$f(\%)=[(90-H/2)/90]\times 100$$

Where, H shows half-value of strength distribution along Debye ring of a crystal face having main peak of crystal of biodegradable filaments. The f value drawn polylactic acid filament by the invention is 60% or more, further there many filament above 70% by drawing well, and there exist one above 75% in very well drawn one. In addition, it occurred also one that the degree of orientation reaches 89.9% according to conducting zone drawing and zone heat treatment to drawn filament by the invention. Above-mentioned the degree of orientation is higher. But, for measuring X-ray orientation degree, it is necessary to measure as a bundle of filaments. But to arrange all filaments of the enormous numbers of filaments bundles to a constant direction is technically difficult because drawn filaments diameters of the invention are small and it is considered that X-ray orientation degree is appeared to be rather low due to that.

The draw ratio λ in the invention is represented by a following equation based on the diameter do for the original filament and the diameter d for the filament after drawing. In this case, calculation is performed assuming the density of filament as constant. The diameter measurement of the filament is conducted by a scanning electron microscope (SEM) based on photographs taken at 350× or 1000×, with respect to average values for 10 points.

$$\lambda=(do/d)^2$$

Advantageous Effects of the Invention

In the invention, concerning biodegradable filament, it was possible to obtain micro-filament easily by simple and convenient means without requiring the special, high-accuracy and high-level devices. Micro-filament obtained by those are 12 μm or less, further 5 μm or less but to obtain micro-filament such as 2 μm and 3 μm, it was also possible to obtain super micro-filament such as 3 μm or less and 2 μm by re-drawing of a zone drawing method, a zone annealing method and the like of drawn filament. This biodegradable micro-filament is realized by super high ratio drawing such as 100 times or more, further 500 times or more and 1000 times or more. To be able to offer realizing means such high ratio drawing, not only the biodegradable micro-filament can be obtained simply and conveniently but also mean that the biodegradable micro-filament can be manufactured at high speed, that the significance from productivity side is large.

Further, long fiber non-woven fabrics consisting of micro-filament could be manufactured by the invention. There are melt blown non-woven fabrics as non-woven fabrics consisting of micro-filament which are on the market but filament has not sufficient strength and small lumps of resins calted shots or wads are also mingled as filaments diameters are irregular such as from 1 μm to 10 μm. Non-woven fabrics of the invention have no such defects, as the filaments diameters have extremely the same level such as ±1 μm or less and have biodegradability, these non-woven fabrics can be used for various applications that are required biodegradability such as agricultural application and diapers. Additionally, spunbonded non-woven fabrics consisting of the biodegradable filament is studied on the market but non-woven fabrics consisting of filament of the invention have also strength and effects that filament diameters are small and the like.

In the invention, fiber products consist of filament differing in biodegradable speed by differing in a diameter, for example, manufacturing product groups of yarn, rope, fabrics, knit fabrics, non-woven fabrics; it was possible to be formed of product groups in conformity with the biodegradable speed of each aimed product. Additionally, highly molecular oriented filament that are super-micro such as 2 to 3 μm can be manufactured and it was possible to be filament with increased biodegradable speed as these are super-micro.

Additionally in the invention, it is possible to obtain micro-filament consisting of bioerodible absorbable polymer such as polyglycolic acid and to be able to make a fine and flexible surgical suture thread; as filament diameters are small, degradability in a biological body is also good.

Moreover, the invention offers non-woven fabrics consisting of micron-filament of bioerodible absorbable polymer. As filament diameter is small, the filament number per unit area is increased extremely (proportional to inverse number of the square of a fiber diameter) to improve covering power. In addition, non-woven fabrics consisting of micro-filament of the invention have characteristics of not having wads, having the equal filament diameter, having high strength of filament and the like, and those also conform to features as bioedrodible absorbable non-woven fabrics. Accordingly, the non-woven fabrics consisting of the bioerodible absorbable filament of the invention conform to wide range of application usages such as suture prosthesis, anti-adhesion material, artificial skin and a cell culture substratum.

BRIEF DESCRIPTION OF THE DRAWINGS

FIG. 7 is a graph of experimental results showing a filament diameter, birefringence and the like according to drawing polylactic acid filament in the invention.

FIG. 8 is a graph of the other experimental results showing a filament diameter, birefringence and the like according to drawing polylactic acid filament in the invention.

FIG. 9 is a graph of experimental results showing a filament diameter, birefringence and the like according to re-drawing drawn polylactic acid filament in the invention.

FIG. 10 is a graph of experimental results showing a filament diameter, birefringence and the like according to drawing polyglycolic acid filament in the invention.

FIG. 11 is a graph of the other experimental results showing a filament diameter, birefringence and the like according to drawing polyglycolic acid filament in the invention.

DESCRIPTION OF THE PREFERRED EMBODIMENTS

Figure 1:
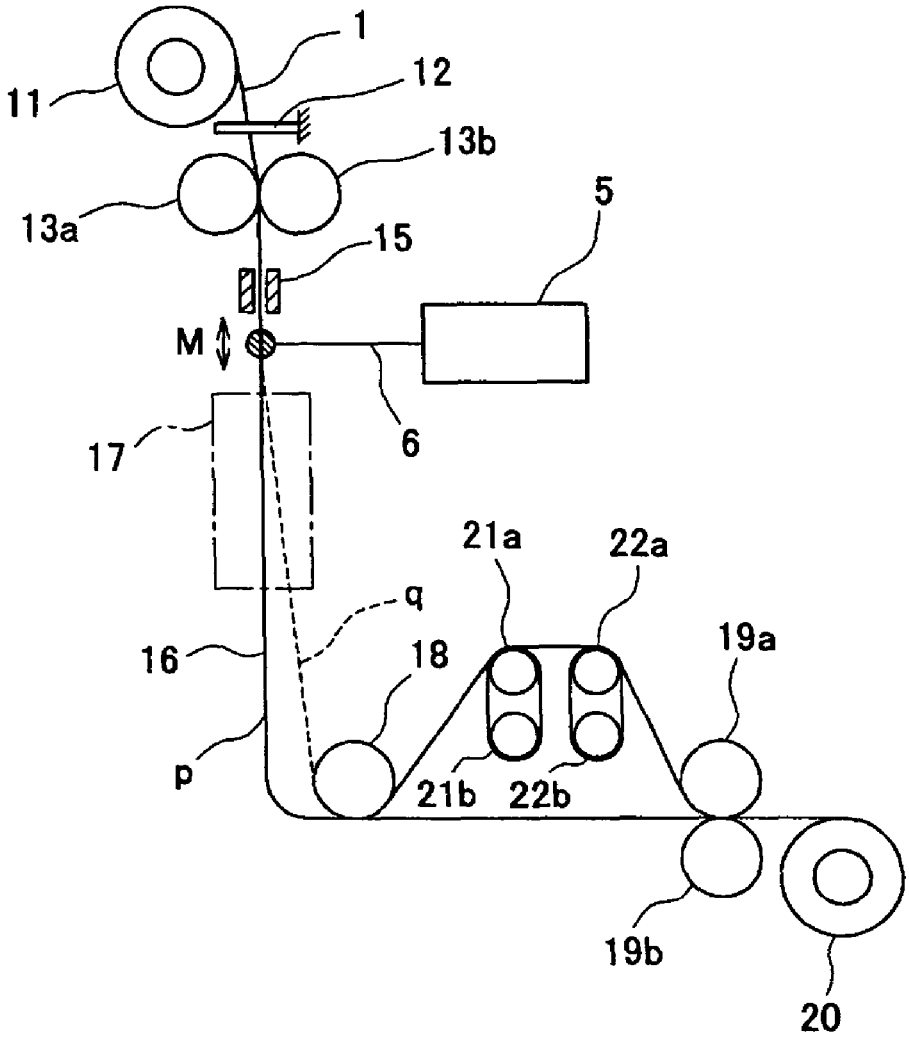
FIG. 1 is a process schematic view of a continuous method for manufacturing the drawn biodegradable filament of the invention.

In the following, the examples of modes to carry out the invention are described based on the drawings. FIG. 1 showed an example of a process for the continuous method of the invention. The original biodegradable filament 1 is reeled off from a state of wound around a reel 11, passed by way of comb 12 and delivered at constant speed from reel off nip rollers 13*a* and 13*b*. The delivered original filament 1 falls down at a constant speed while being regulated for the position by guiding tool 15. The guiding tool 15 is used for accurately determining the laser irradiation position and running position of the filament. While a hypodermic needle with an inner diameter 0.5 mm was used in the drawing, a narrow pipe, a comb, or snail-wire, etc. shown in FIG. 6 can also be used. A laser beam 6 is irradiated to a zone heater M of predetermined width by a laser emitter 5 to the running original filament 1 just below the guiding tool 15. This laser beam 6 is preferably irradiation from plural directions shown in FIG. 2 and FIG. 3. The filament is heated by the laser beam 6 and drawn by the own weight of the original filament or the drawing tension given by take-up nip roller 19, and falls down as drawn biodegradable filament 16 and is preferable to pass through a heat treatment zone 17 formed in the falling path. The drawn biodegradable filament 16 passes along a pulley 18 and then wind-up by way of take-up nip rollers 19*a* and 19*b* around wind-up reel 20. In this case, the channel of the drawn biodegradable filament 16 to pulley 18 includes a case where it is drawn as a trace "p" of a free falling of the filament, a case where it is drawn as a linear trace "q" to pulley 18 and a case where it is drawn as an intermediate trace thereof. In the trace "q" and at the intermediate position of the trace "p" and the trace "q", wind-up tension exerts on the drawing tension in which the drawing tension is preferably 10 MPa or less. The drawing tension may be measured by a tension measuring mechanism dispose to the pulley 18 but as another method, it can be estimated based on the relation of the same supplying speed, the laser irradiation condition and the draw ratio by the load cell measurement of a batch method. Before wind-up around the take-up and wind-up reel 20, the filament can be further drawn between the heated drawing rolls 21*a*, 21*b* and the drawing rolls 22*a* and 22*b* by a speed ratio of the drawing rolls 21 and 22. The heat treatment zone 17 for the drawn biodegradable filament in this case is preferably disposed subsequent to the drawing roller 22. Also, when the plural original filaments are drawn simultaneously, it is preferable to have been air interlaced among filaments by a interlace method and the like just before the take-up reel. Additionally, providing a measuring device for a filament diameter to a position such as just before entering the pulley 18 and take-up roller 19, it is possible to obtain a product of always a constant filament diameter controlling take-up speed or supply speed and the like by feeding back the measured filament diameter.

Figure 2:
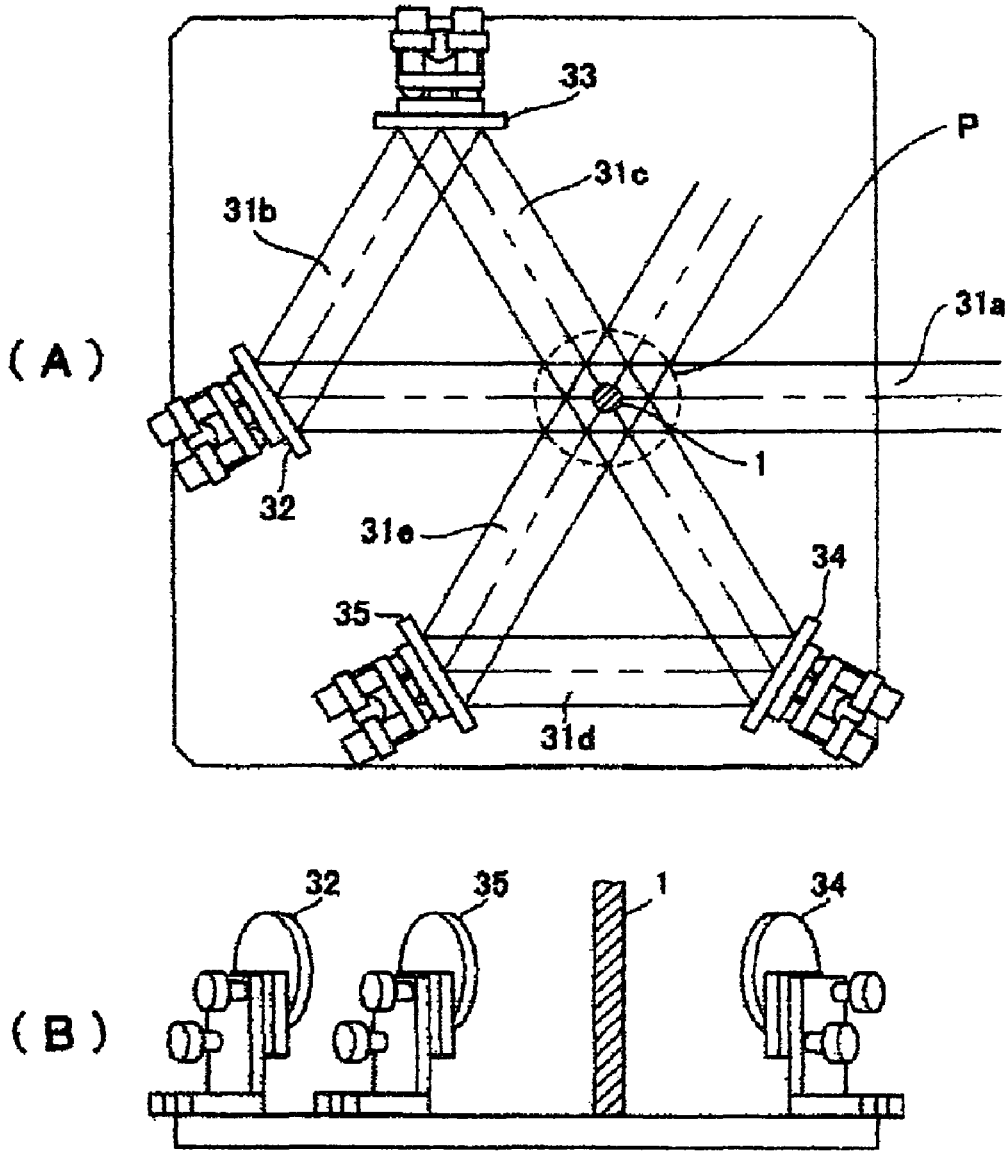
FIG. 2 shows an example of mirror arrangement to irradiate infrared beams from plural directions to original filament of the invention, and Fig. A in FIG. 2 is a plain view and Fig. B in FIG. 2 is a side view.

FIG. 2 shows an example of means to irradiate the infrared beam adopted in the invention to the original biodegradable filament from plural directions. Fig. A in FIG. 2 is a plain view and FIG. B in FIG. 2 is a side view. The infrared beam 31*a* irradiated from the infrared emitter reaches the mirror 32 through the region P (inside dotted line in the drawing) where the original filament 1 passes through and is the infrared beam 31*b* reflected by mirror 32, and is infrared beam 31*c* reflected by the mirror 33. The infrared beam 31*c* irradiates the original filament through the region P from 120 degree behind of the first irradiation position of the original filament. The infrared beam 31*c* passed through the region P is the infrared beam 31*d* reflected by mirror 34, which is the infrared beam 31*e* reflected by the mirror 35. The infrared beam 31*e* irradiates the original filament 1 through region P from opposite 120 degree behind direction of foregoing infrared beam 31*c* against the fist irradiation position of the original filament. Thus, the original filament 1 can be equally heated from the symmetrical position 120 degrees apart by the three infrared beams 31*a*, 31*c* and 31*e*.

Figure 3:
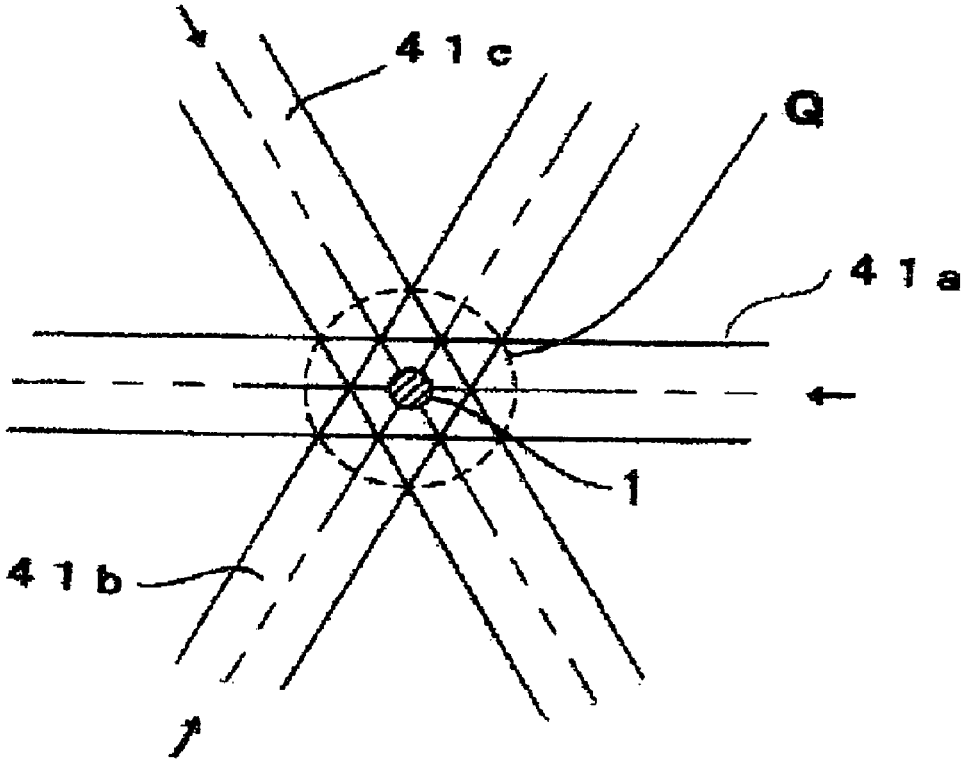
FIG. 3 shows a plain view of the other example to irradiate infrared beams from plural directions to original filament of the invention in case of having plural light sources.

In FIG. 3, the other example of means adopted in the invention to irradiate the infrared beams to the original filament from the plural directions that is an example of using plural light sources is shown in a plain view. The infrared beam 41*a* radiated from the infrared emitter is radiated to the original biodegradable filament 1. And infrared beam 41*b* radiated from the other infrared emitter is also radiated to the original biodegradable filament 1. Further, the infrared beam 41*c* radiated from the other infrared emitter is also radiated to the original biodegradable filament 1. Thus, the radiation from the plural light sources can be the high power light sources using the plural laser emitters which are relatively small light sources and are stable and not expensive. Still, a case using 3 light sources are shown in the drawing but 2 are possible and 4 or more can also be used. Especially, when drawing the plural filaments, drawing by using the plural light sources like these is particularly useful.

Figure 4:
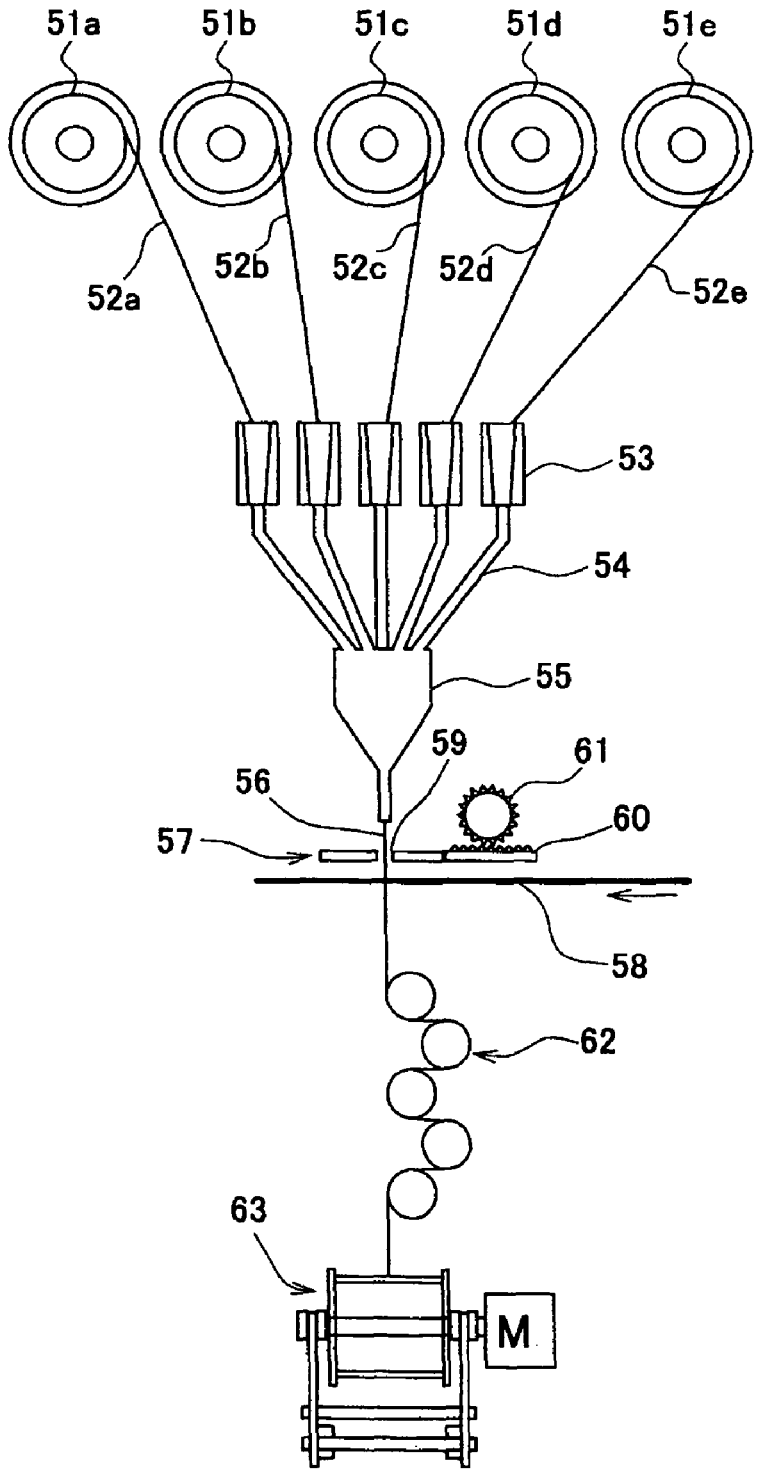
FIG. 4 is a schematic view of a process in case of re-drawing plural numbers of drawn biodegradable filaments of the invention.

In FIG. 4, there is shown an example of the biodegradable filaments already drawn by this invention is reeled off the plural number at the same time and drawing simultaneously. The drawn biodegradable filament 52*a*, 52*b*, 52*c*, 52*d* and 52*e* wound-up around the bobbins 51*a*, 51*b*, 51*c*, 51*d* and 51*e* are each delivered through the blowing duct 53 and the pipe 54 and are gathered in an air manifold 55, and are filaments assembly 56. Still, the biodegradable filaments 52 in the blowing duct 53 and the pipe 54 is not shown in the drawing as is complicated. It is preferable that the bobbins 51 are lowered the reel off tension by rotating at the constant speed because the un-drawn original filament has a low tensile strength and Young's modulus, and fineness of the drawn filaments are small that they can not resist the tension. The delivered filaments assembly 56 are adjusted a running position to be the center of laser beam 58 by a variable pitch mechanism 57. The variable pitch mechanism 57 is provided with the guiding tool 59 and the running position of the filaments are finely adjusted the position by a rack 60 and a gear 61. As for the variable pitch mechanism 57, an example to adjust in one direction only is shown in the drawing but can be adjusted in XY axis directions by providing a set of gears in a right angle. The filaments assembly 56 adjusted the position by the variable pitch mechanism 57 is heated by the laser beam 58 and drawn, and adjusted to the constant take-up speed by take-up mechanism 62 and wound-up to the wind-up bobbin 63 driven by a motor M. In this drawing, the laser beam 58 is shown by one line but is preferably the plural light beams shown in FIG. 2 and 3. Additionally, an example wound-up directly around bobbins is shown in the drawing but it is preferable to wind-up adding twisting and intertwining among the filament by the interlacing and the like. Also, an example of re-drawing by the infrared beam is shown in FIG. 4, but the re-drawing can use also the other drawing means of ordinary roller drawing, zone drawing and so on. Still, the air introduced to the blowing duct 53 and the pipe 54 is guided to a channel of the original filament 1 and the filament is delivered by the flow of air, and the tension given by the wind velocity delivering air is added to the drawing tension of the invention. Yet, FIG. 4 is described as an example of re-drawing of the drawn filament but used also as the means for the plural numbers drawing of the un-drawn original filaments with the similar mechanism.

Figure 5:
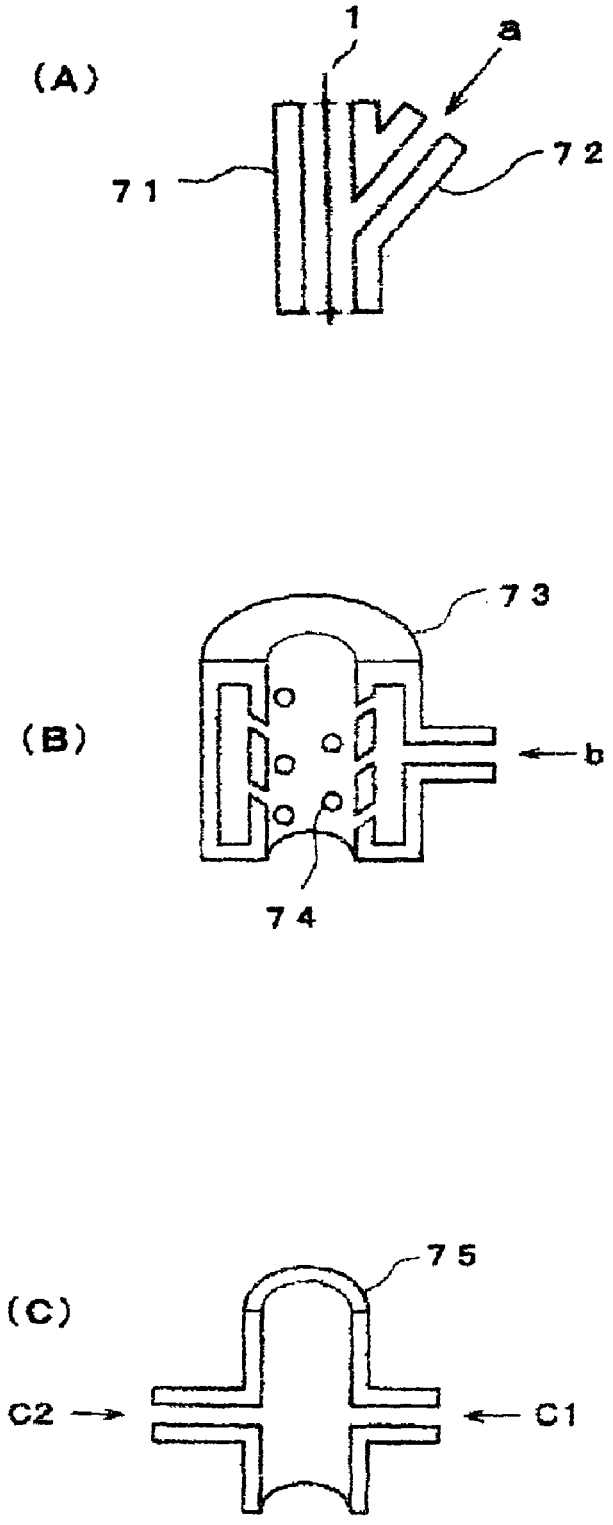
FIG. 5 is a schematic view of blowing ducts used in the invention.

FIG. 5 shows examples of various blowing ducts adopted in the invention. In FIG. A of FIG. 5, air introduced from an arrow "a" through a branched duct 72 joins to a main duct 71 where the filament 1 passes through. FIG. B in FIG. 5 shows a double walled duct 73 in which the inside is hollow and air introduced along an arrow "b" is guided through a number of apertures 74 perforated in the inner wall of the double walled duct to the channel of the filament. FIG. C in FIG. 5 shows an example of a nozzle used as an air interlace nozzle 75 used for interlace spinning in which the air is blown from both sides c1 and c2. Thus, the reason why the air is actively delivered to the running direction of the filament is not to disturb the running of the filament by the resistance of guiding tool etc. as the drawing tension is small in the invention and it is also possible to add the drawing tension by the momentum of the air when adding the tension actively with the wind-up tension is not possible such as in a case of manufacturing non-woven fabrics. Also, the nozzle in FIG. C of FIG. 5 can be used at the time of interlace winding after drawing of the invention. Yet, the blowing ducts in FIG. 5 show the examples of the tubular shape but a grooved shape which is partially open is also used.

Figure 6:
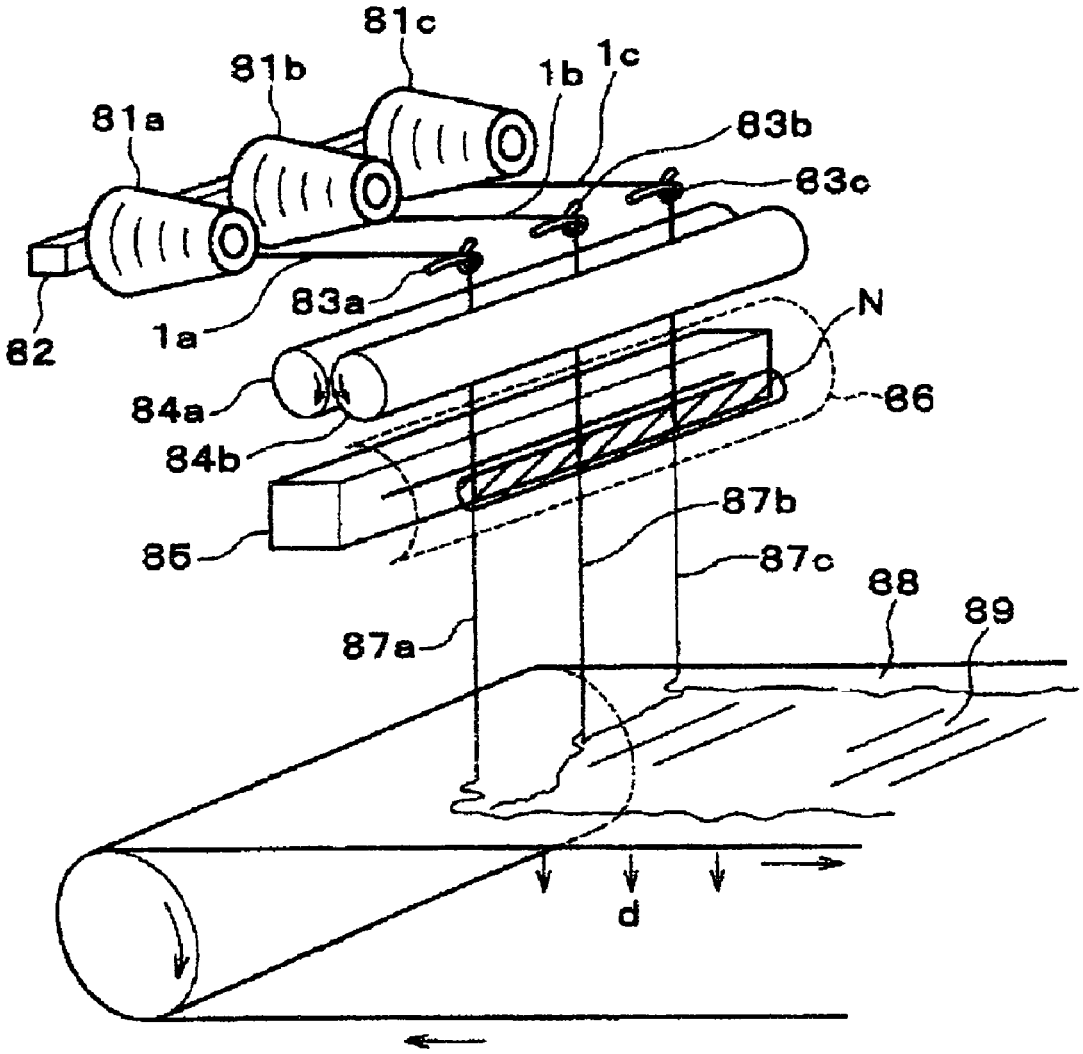
FIG. 6 is a schematic view of the process for manufacturing non-woven fabrics consisting of the drawn biodegradable filaments of the invention.

FIG. 6 shows an example of manufacturing non-woven fabrics of the invention. Multiplicity of the original biodegradable filaments 1 are attached to a rack 82 in a state wound around bobbin 81 (for avoiding complexity, only three filaments are shown). These original biodegradable filaments 1*a*, 1*b*, and 1*c* are delivered through snail wires 83*a*, 83*b* and 83*c* as the guiding tool by the rotation of supply nip rolls 84*a* and 84*b*. The supplied original biodegradable filaments 1 are heated in the course of falling down by the own weight, by line infrared beams emitted from an infrared emitter 85. The range for the heating portion "N" by the infrared beams in the running process of the original biodegradable filaments 1 are shown by hatched lines. Beams passing through original biodegradable filaments 1 with no absorption are reflected at a concave mirror 86 shown by dotted line and then returned to be condensed to the heating portion "N". A concave mirror is disposed also on the side of the infrared emitter 85 (in this case, the beam traveling portion from infrared emitter has an open window), which is not illustrated in the drawing. The original biodegradable filaments 1 are heated by radiation heat of infrared rays at the heating portion "N", drawn by the own weight of filament per se by portion there below and formed into drawn biodegradable filaments 87*a*, 87*b* and 87*c*, which are accumulated on a running conveyor 88 to form a web 89. Air is sucked in the direction of an arrow "d" by vacuum suction from rear face of the conveyor 88 to contribute to the stability of running of the web 89. The web is pulled by the tension of the negative pressure "d" exerting on the drawn biodegradable filaments 87 to contribute to the improvement of attenuation and orientation degree of the biodegradable filament and such tension is also regarded as a portion of the tension caused by the own weight in the invention. Although not illustrated in the drawing, a number of bobbins 81 for the original biodegradable filaments 1 are provided in a multi-stage along the running direction of the conveyor 88, and nip rolls 84 and infrared emitters are provided in a multi-stage to improve the productivity of the web 89. In case of providing the supply nip rolls 84 etc. in the multi-stage along the running direction, the infrared emitter 85 and the concave mirror 86 can also be utilized for several stages. Yet, in a case that drawing and orientation are small since the drawing tension by the own weight of the filament and the negative pressure from rear face of the conveyor is not sufficient, guiding the filament by blowing duct when the original filaments 1 are guided to the infrared beam portion, the tension given by the air delivering wind velocity of the blowing duct is also added and used.

Example 1

The un-drawn filament consisting of polylactic acid polymer (filament diameter: 75 μm, glass transition temperature: 57° C., crystallization temperature: 103° C., tensile strength: 55 MPa, birefringence: 0.063) were used as the original biodegradable filament. Using the original filament, drawing was conducted using the drawing apparatus of FIG. 1 and the mirror of FIG. 2 for an infrared emitter. The laser emitter in this time, a carbon dioxide gas laser emitter manufactured by Onizuka Glass Co., Ltd. with a maximum power of 10 W was used. A diameter of a laser beam at the time was 4 mm. Delivering this original filament at supply speed of 0.5 m/min and a laser power density being 24 W/cm$^2$, and the experiments were conducted by changing wind-up speed. FIG. 7 shows filaments diameters of drawn filament obtained by the experiment, draw ratio calculated from filaments diameters, birefringence and X-ray orientation degree of drawn filament and values of the drawing tension obtained from a batch method that lead to the filament diameter and the orientation degree. From FIG. 7, at appropriate condition, a filament diameter is 5 μm or less, even reached from 3 μm to 1.2 μm. The draw ratio is 100 times or more and has reached 1,000 times or more, even 3,900 times. The birefringence is 0.015 (round off 0.01478) or more and has reached 0.020 or more, even 0.033. The X-ray orientation degree is 60% or more and has reached even 75% exceeding 70%. In such a case, the drawing tension is within a range from 0.3 MPa to 2.5 MPa.

Example 2

An example when laser power density was made to 12 W/cm$^2$ with the condition of Example 1 is illustrated in FIG. 8. From FIG. 8, a filament diameter is 5 μm or less, and the draw ratio is 100 times or more and has reached 500 times or more. In such a case, the draw ratio is within a range from 0.3 MPa to 2.7 MPa.

Example 3

The filaments obtained by the method of Example 1 of the invention were conducted re-drawing and heat treatment according to a zone drawing method and a zone annealing method. The results are shown in FIG. 9. From FIG. 9, it is understandable that filaments are highly molecular orientated as the draw ratio has reached from 3900 times even to 15000 times and the birefringence has reached 0.030 or more, even 0.040 or more. And, also the filaments diameters are 3 μm or less and super micro-filaments of 2 μm are obtained.

Example 4

The un-drawn filament (filament diameter: 82.34 μm, melting point temperature: 219° C., tensile strength: 89 MPa, birefringence: 0.0043) consisting of polyglycolic acid (low viscosity products, viscosity at 240° C.: 1.24×1000 Pa·S) was used as original biodegradable filament. Using this original filament, drawing was conducted by a drawing apparatus and an infrared emitter similar to Experiment 1. Delivering the original filament with supply speed of 0.5 m/min, the experiment was conducted changing wind-up speed. The filaments diameters of the drawn filament obtained by the experiment, draw ratio calculated from the filament diameters and birefringence of the drawn filaments are shown in FIG. 10. From FIG. 10, the filaments diameters are 5 μm or less at appropriate condition and are fine to an extent from 3 μm to 2.2 μm. Draw ratio is 100 times or more and has reached 1,000 time or more, even 1,300 times. Birefringence is 0.015 or more, and has reached 0.020 or more, even 0.027.

Example 5

At the condition of Experiment 4, the un-drawn filament (filament diameter: 207 μm, temperature at a melting point: 218° C., tensile strength: 0.11 GPa, birefringence: 0.0013) consisting of a medium density viscosity product (viscosity at 240° C.: 3.41×1000 Pa·S) for original polyglycolic acid was used. Using this original filament, drawing was conducted according to a drawing apparatus and an infrared emitter similar to Experiment 4. Delivering this original filament at supply speed of 0.5 m/min, experiments were conducted by changing wind-up speed. FIG. 11 shows the filament diameters of the drawn filament obtained by the experiment, draw ratio calculated from filament diameters and birefringence of the drawn filament. From FIG. 11, the filaments diameters are 10 μm or less at appropriate condition and have become thinner to 5 μm. Draw ratio is 100 times or more and has reached 500 times or more, even 1,500 times. Birefringence is 0.015 or more, further 0.020 or more, and even has reached 0.026.

Experiment 6

A filament of filament diameter 1.82 μm and birefringence of 0.056 was obtained by further drawing a drawn filament of 2.5 μm obtained from a method of Experiment 4 of the invention at 170° C. A filament for a suture thread made of polyglycolic acid on the market was a filament diameter of 14 μm and birefringence of 0.060, it is understandable that a filament obtained by the invention is super-micro and also the orientation degree is near to products on the market.

Industrial Applicability

The invention relates to drawing of a biodegradable filament, the drawn biodegradable filament of the invention is used for rope for agriculture, non-woven fabrics for mulching, non-woven fabrics for diapers and the like that are required biodegradability, and bioerodible absorbable filament is used for surgical suture thread, and in forms of non-woven fabrics, suture prosthesis, anti-adhesion material and the like.

The invention claimed is:

1. A method for manufacturing drawn synthetic biodegradable filament, comprising:

a. providing a synthetic biodegradable filament;

b. delivering the synthetic biodegradable filament through a blowing duct prior to heating and drawing, wherein the delivering comprises flowing a gas in the blowing duct, wherein delivering the synthetic biodegradable filament through a blowing duct guides the filament without resistance;

c. heating the synthetic biodegradable filament in a narrow zone using infrared beams radiated from multiple directions, wherein the narrow zone comprises a range of within 4 mm up and down the axis direction of the filament form the filament center;

d. applying a tension of 10 MPa or less per single filament; and e. drawing the synthetic biodegradable filament to a draw ratio of 100 times or more.

2. A method for manufacturing drawn synthetic biodegradable filament according to claim 1, wherein said drawn synthetic biodegradable filament is heat treated by a heating zone provided subsequently.

3. A method for manufacturing drawn synthetic biodegradable filament according to claim 2, wherein said heat treatment is conducted by a zone heat treatment method.

4. A method for manufacturing drawn synthetic biodegradable filament according to claim 1, wherein said drawn synthetic biodegradable filament is further drawn.

5. A method for manufacturing drawn synthetic biodegradable filament according to claim 4, wherein said further drawing is conducted by a zone drawing method.

6. A method for manufacturing drawn synthetic biodegradable filament according to claim 1, wherein said original synthetic biodegradable filament is drawn at the same time in the same beams delivering plural numbers simultaneously.

7. A method for manufacturing drawn synthetic biodegradable filament according to claim 1, wherein said drawn synthetic biodegradable filament is accumulated on a running conveyor.

8. The method for manufacturing drawn synthetic biodegradable filament according to claim 1, wherein the original synthetic biodegradable filament is an aliphatic polyester.

9. The method for manufacturing drawn synthetic biodegradable filament according to claim 1, wherein the original synthetic biodegradable filament is polyglycolic acid, polylactide, polyglutamic acid, poly-p-dioxic acid, poly-α-malic acid or pol-β-hydroxybutyric acid.

* * * * *